US011896883B2

(12) United States Patent
Sutta et al.

(10) Patent No.: US 11,896,883 B2
(45) Date of Patent: Feb. 13, 2024

(54) HOCKEY TRAINING DEVICE

(71) Applicants: Peters Sutta, Riga (LV); Janis Leitans, Riga (LV)

(72) Inventors: Peters Sutta, Riga (LV); Janis Leitans, Riga (LV)

( * ) Notice: Subject to any disclaimer, the term of this patent is extended or adjusted under 35 U.S.C. 154(b) by 225 days.

(21) Appl. No.: 17/596,576

(22) PCT Filed: Aug. 6, 2020

(86) PCT No.: PCT/IB2020/055356
§ 371 (c)(1),
(2) Date: Dec. 14, 2021

(87) PCT Pub. No.: WO2020/254911
PCT Pub. Date: Dec. 24, 2020

(65) Prior Publication Data

US 2022/0233936 A1 Jul. 28, 2022

(30) Foreign Application Priority Data

Jun. 19, 2019 (LV) ..... P-19-31

(51) Int. Cl.
*A63B 69/00* (2006.01)
*A63B 102/24* (2015.01)

(52) U.S. Cl.
CPC ..... *A63B 69/0026* (2013.01); *A63B 69/0097* (2013.01); *A63B 2102/24* (2015.10)

(58) Field of Classification Search
CPC ..... A63B 2102/24; A63B 69/0026
USPC ..... 473/446
See application file for complete search history.

(56) References Cited

U.S. PATENT DOCUMENTS

| | | | | |
|---|---|---|---|---|
| 5,351,960 | A * | 10/1994 | Knapp | A63B 69/3676 473/182 |
| 8,469,841 | B1 * | 6/2013 | Giauque | A63B 69/0097 473/446 |
| 9,636,561 | B2 * | 5/2017 | Simon | A63B 69/0026 473/446 |
| 10,668,345 | B2 * | 6/2020 | Goldwitz | A63B 69/0024 473/446 |
| 2005/0032580 | A1 * | 2/2005 | Rango | A63B 57/357 473/185 |
| 2022/0233936 | A1 * | 7/2022 | Sutta | A63B 69/0026 473/446 |

* cited by examiner

*Primary Examiner* — Mitra Aryanpour
(74) *Attorney, Agent, or Firm* — Patshegen IP; Moshe Pinchas

(57) ABSTRACT

The present invention relates to training devices used in the stick sports, particularly hockey, to improve users or corresponding stick sport players stick-handling and puck passing abilities. Hockey puck rebound device (1) comprises a first support (2) and a second support (22), at least one resilient member (20) extending between the first support (2) and the second support (22) such that the resilient member (20) is secured in a taut manner to provide a resilient spring-back force when struck by a puck (50), a cross-member (30) extending between the first support (2) and the second support (22). Each support (2, 22) comprises at least one channel (7) for inserting and securing the resilient member (20) to the support (2, 22).

6 Claims, 9 Drawing Sheets

HOCKEY TRAINING DEVICE

The present invention relates to training devices used in the stick sports, particularly hockey, to improve users or corresponding stick sport players stick-handling and puck passing abilities.

US patent application publication No. US 2015/0297967 discloses a hockey puck rebound device comprising flat sheet and plurality of elastic bands suspended to the upper surface of the flat sheet. Vertical posts are attached to the flat sheet so that the elastic band is secured about said vertical posts. The elastic band includes a front surface facing towards a centre portion of the flat sheet. Therefore, a puck may be passed towards the elastic band and the elastic band rebounds the puck towards the user.

US patent publication No. U.S. Pat. No. 8,469,841 discloses a hockey puck rebounder having a frame, a first and second support each extending from opposing ends of the frame, a resilient rebound member comprised of an endless-looped band and extending between the first and second supports such that the resilient rebound member is secured in a taut manner to provide a resilient spring-back force when struck by a hockey puck.

The objective of the present invention is to design a hockey puck rebound device, which is easy to fabricate, assembly and disassembly.

The aim of the invention has been achieved by designing a hockey puck rebound device comprising a first support and a second support, a cross member extending between both supports and secured to each support, and a resilient member extending between the supports such that the resilient member is secured in a taut manner to provide a resilient spring-back force when struck by a puck.

The support comprises a top wall, a bottom wall and four side walls of substantially equal length. The support is a hollow body with support ribs therein. The bottom wall of the support when in use is positioned on a training surface.

The support comprises at least one channel for inserting and securing the resilient member to the support. The channel comprises a 45 to 90 degree turn in result of which the channel has a first section and a second section so that upon insertion of the resilient member into the channel the resilient member is arranged in the first and the second section of the channel. A first section is before the turn, but a second section is after the turn if looking from a perspective of inserting the resilient member. In result of which the first section of the channel is substantially parallel to the top and bottom walls of the support, but the second section of the channel is substantially orthogonal to the top and bottom walls of the support, when the turn in the channel is approximately 90 degrees. The channel further comprises a cut-out parallel to a longitudinal axis of first section of the channel so that a slot is formed between the channel and the top wall of the support and through the slot the resilient member may be inserted into the channel. The first section of the channel is arranged in 45 to 90, preferably 90 degrees angle relative to the second section of the channel. Moreover, a diameter of the second section of the channel is larger than a diameter of the first section of the channel.

The support comprises at least one hexagonal cavity configured for insertion of a respective hexagonal nut therein. The hexagonal cavity restricts a rotation of therein inserted hexagonal nut.

The support comprises at least two through holes, where each hole is configured for insertion of a screw therethrough in order to fix the cross-member to the support.

The resilient member having a first and a second end and, wherein on each end of the resilient member a rigid ring is arranged so that the end of the resilient member is rigid.

The cross-member extending between the first support and the second support and fixed to the top wall of both supports so that both supports are positioned from each other with a distance.

The device further comprises a rubber pad attached to the bottom surface of the support covering thereof.

The device further comprises a means for securing said frame to a training surface in a stationary manner The means comprises a hexagonal nut, a bolt and a washer. The hexagonal nut is configured so that upon insertion of the hexagonal nut in the hexagonal cavity of the support, the rotational movement within the hexagonal cavity is avoided. The bolt is configured to be screwed into the hexagonal nut so that the support is secured to the training surface in a stationary manner The washer is arranged onto the bolt and positioned between the bottom wall of the support and the training surface.

The device may further comprises a spike configured to be insertable into the hexagonal nut arranged within the hexagonal cavity of the support.

In one of the embodiments the support may comprise two parallel arranged channels for inserting and securing the resilient member to the support and the device comprises two resilient member, wherein each resilient member is inserted and secured into the channel of support so that between the supports are parallelly arranged two resilient members. The following feature allows to use the device from both sides as well as allows to adjust rebounding force to provide optimal return force.

The figures provided below give a detailed description of the invention.

Figure 8:
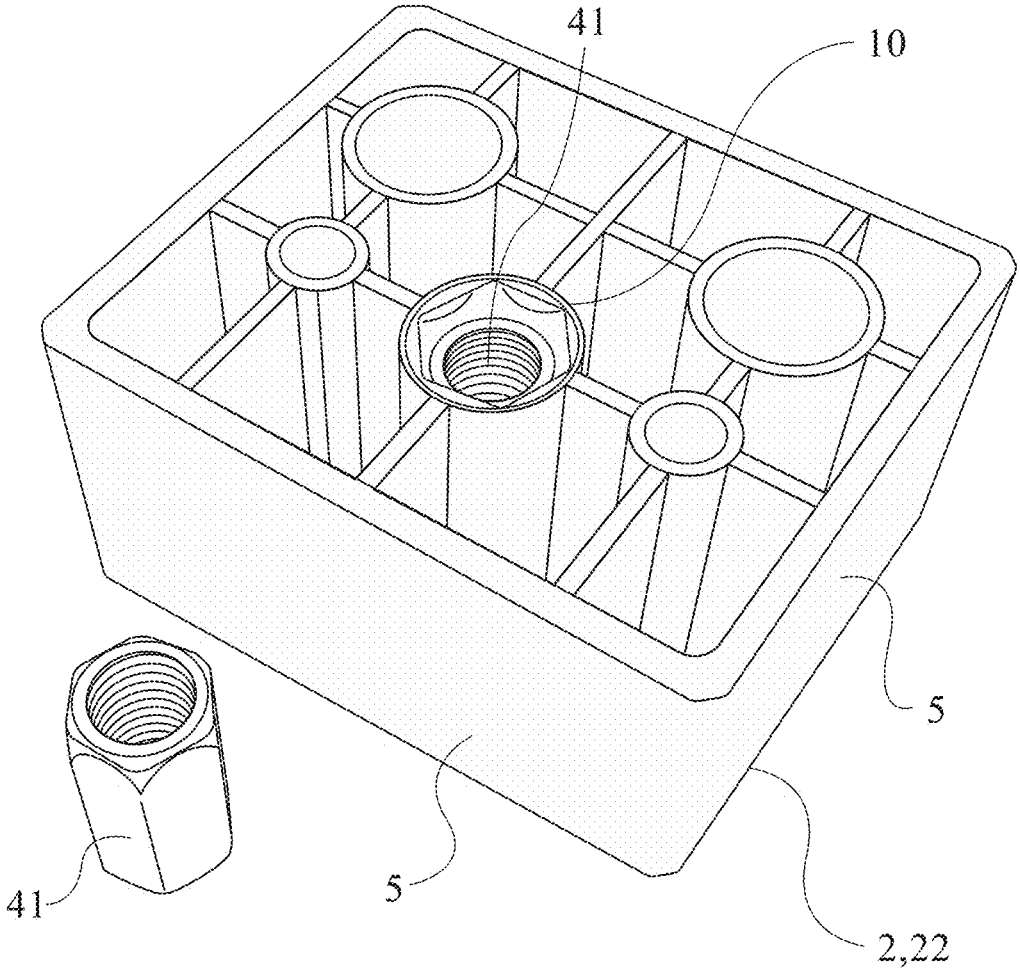

FIG. 8 is an upper perspective view of the support 2, 22 with a hexagonal nut 44 alongside the support 2, 22 and another hexagonal nut 44 is inserted into a hexagonal cavity 10 of the support 2, 22.

Figure 9:
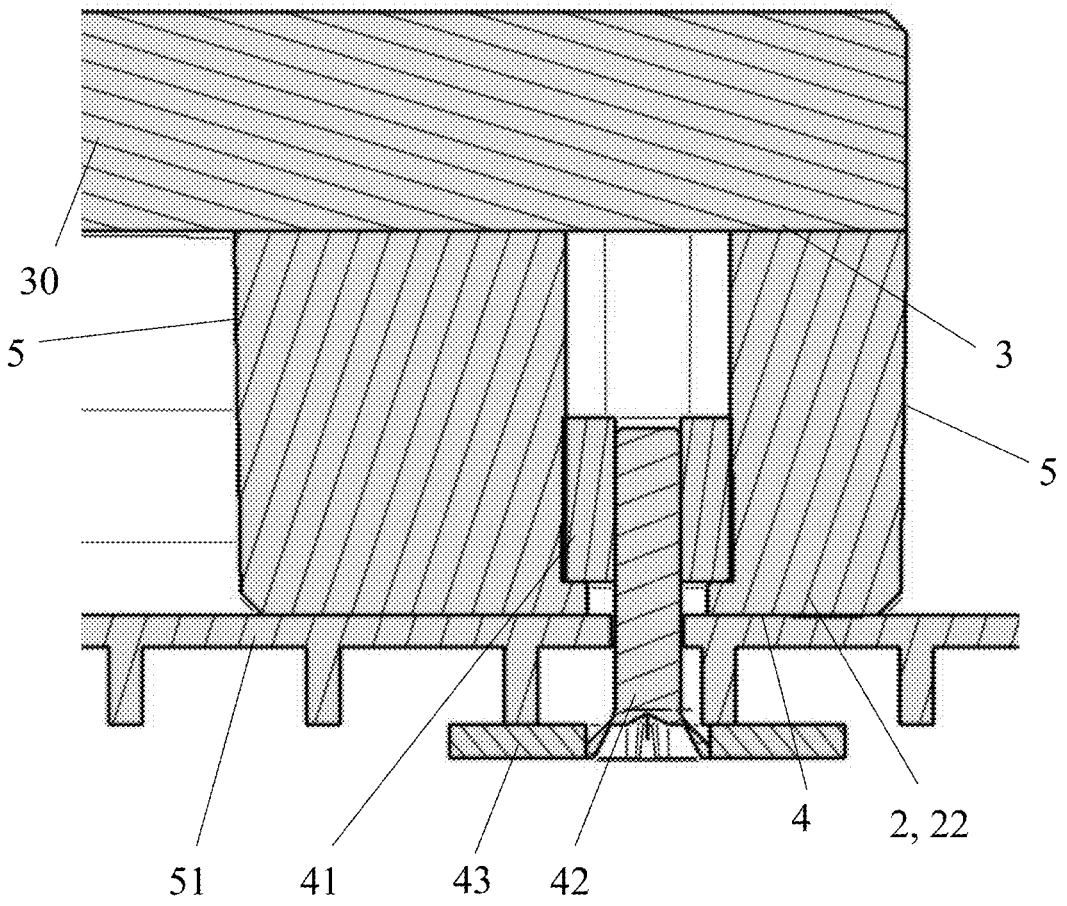

FIG. 9 is a sectional view of the support 2, 22 attached to a training surface 51.

Figure 10:
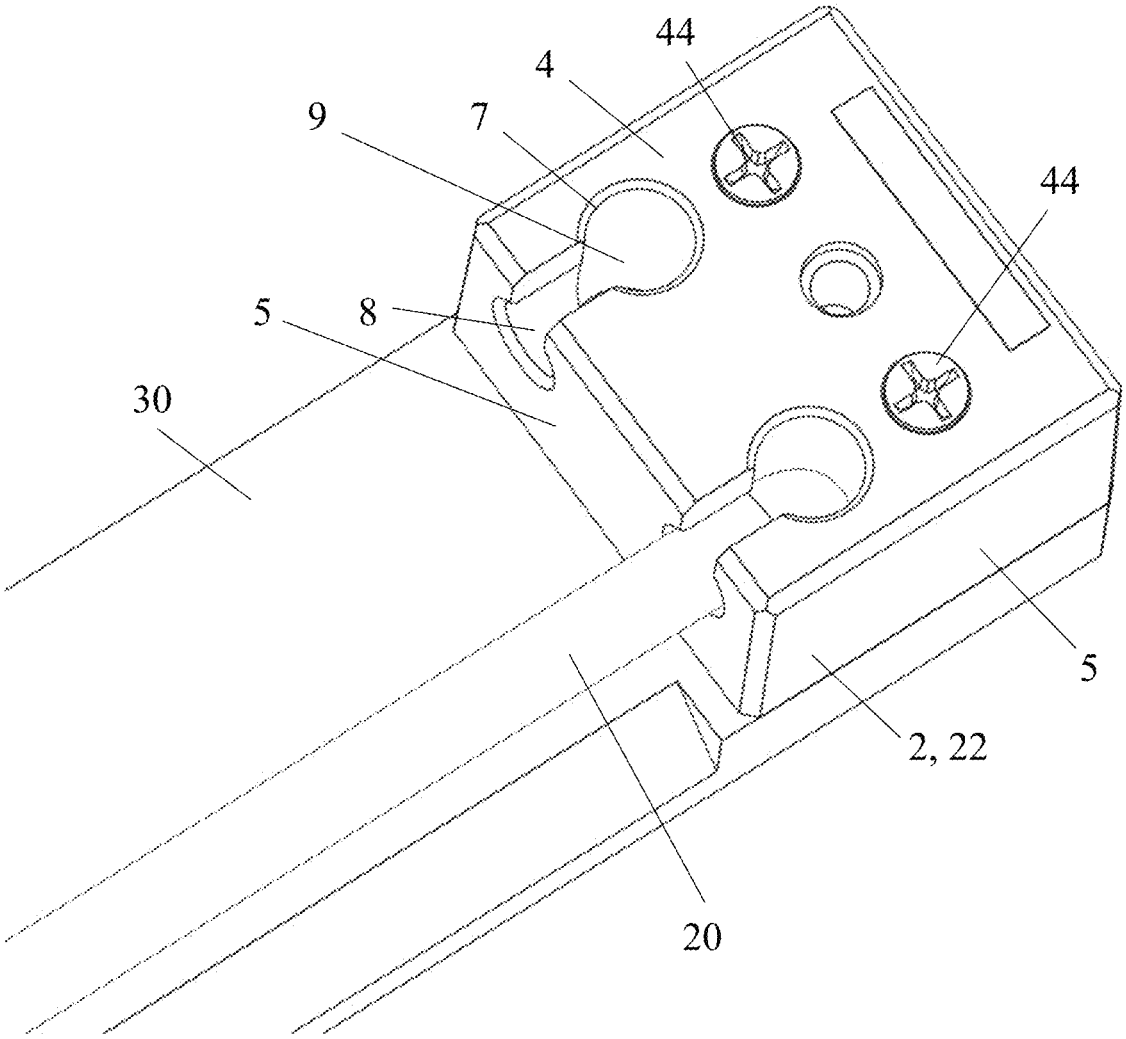

FIG. 10 is another perspective view of part of the device 1 comprising a support 2, 22 attached to a cross-member 30, and one resilient member 20 secured into a channel 7 of the support 2, 22.

Figure 11:
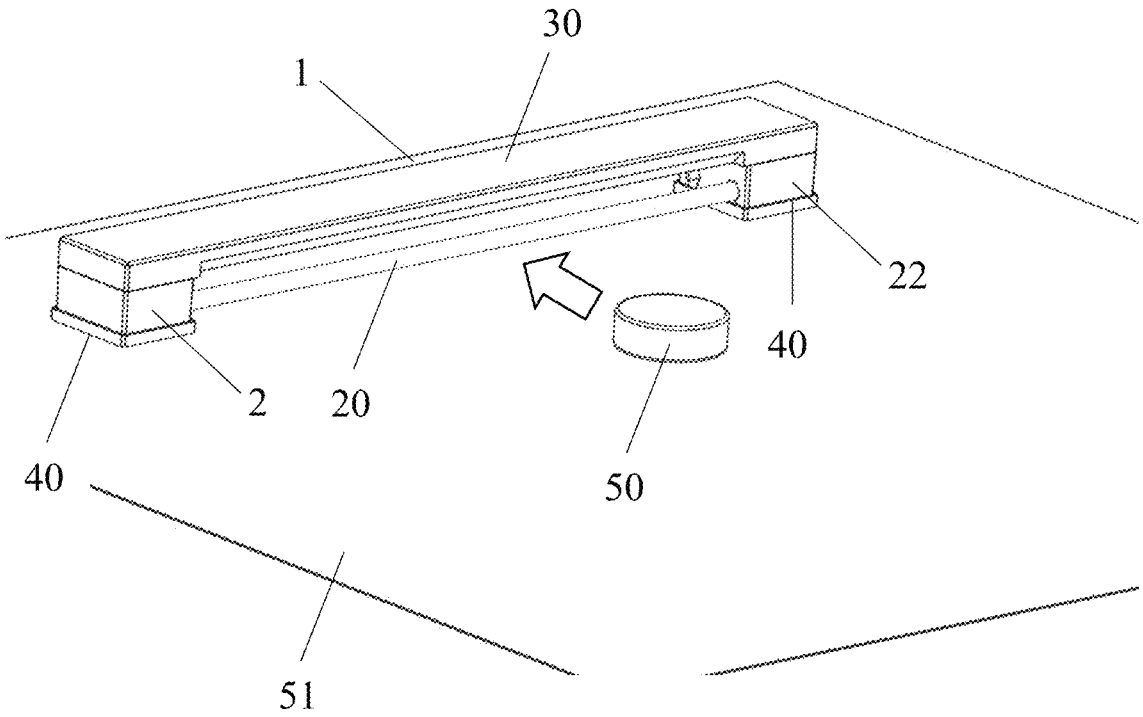

FIG. 11 is perspective view of the device 1 positioned on the training surface 51 when in use.

Other objects and features of the present invention will become apparent when viewed in light of the detailed description of the preferred embodiment when taken in conjunction with the attached drawings and appended claims.

Figure 1:
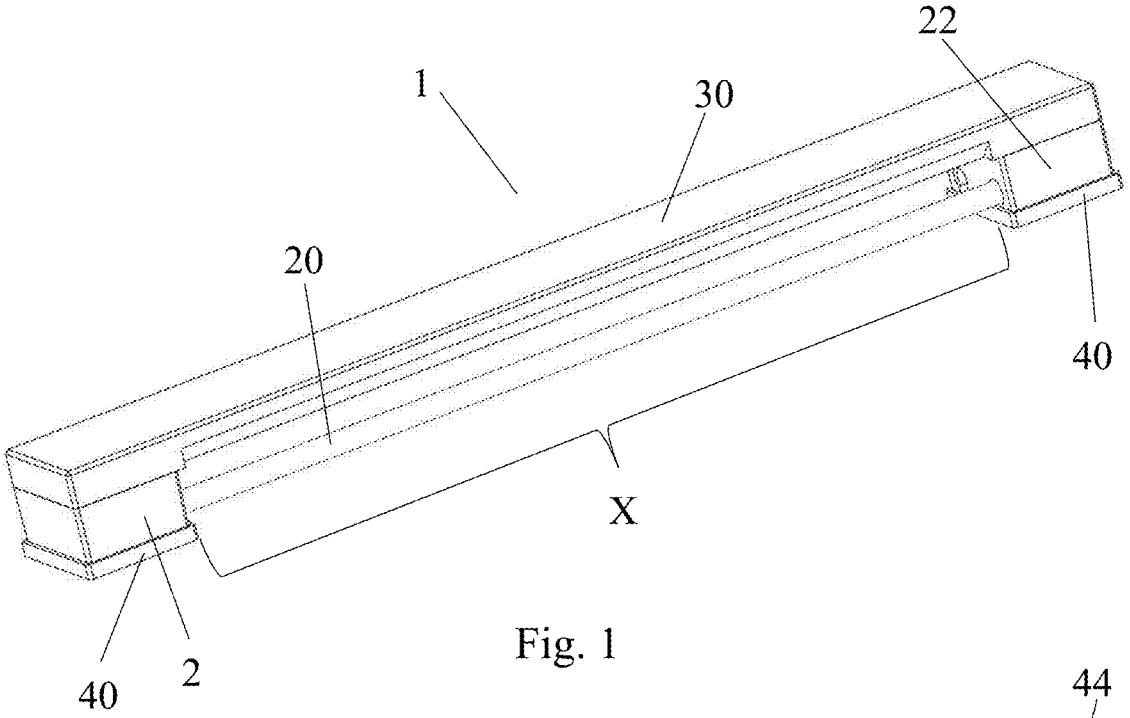
FIG. 1 is a perspective view of a hockey puck rebound device 1.
Figure 2:
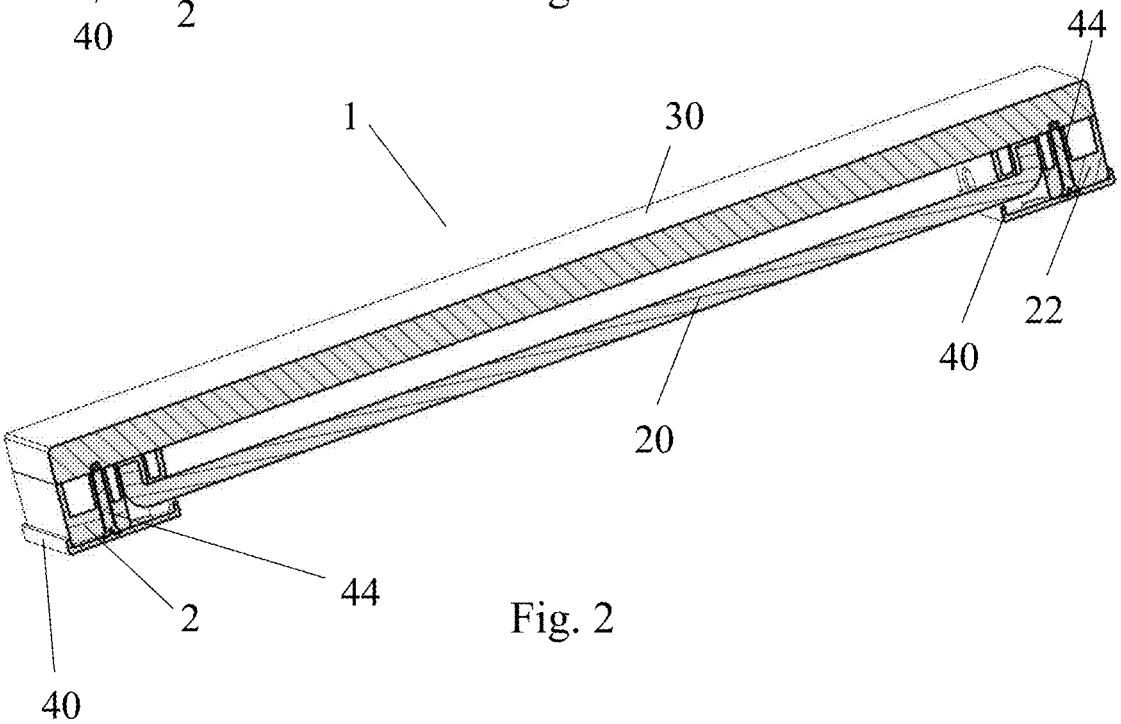
FIG. 2 is a sectional view of the hockey puck rebound device 1 as seen in FIG. 1.
Figure 3:
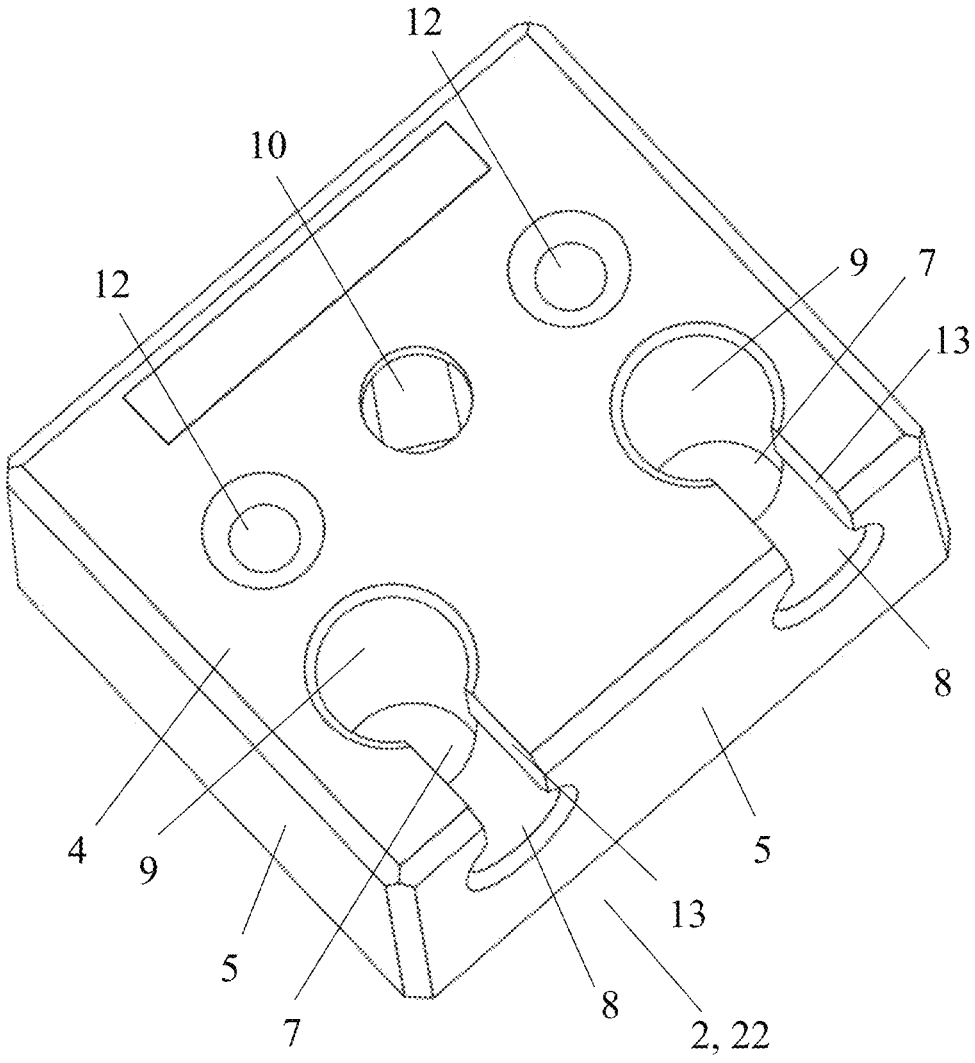
FIG. 3 is a bottom perspective view of the support 2, 22.
Figure 4:
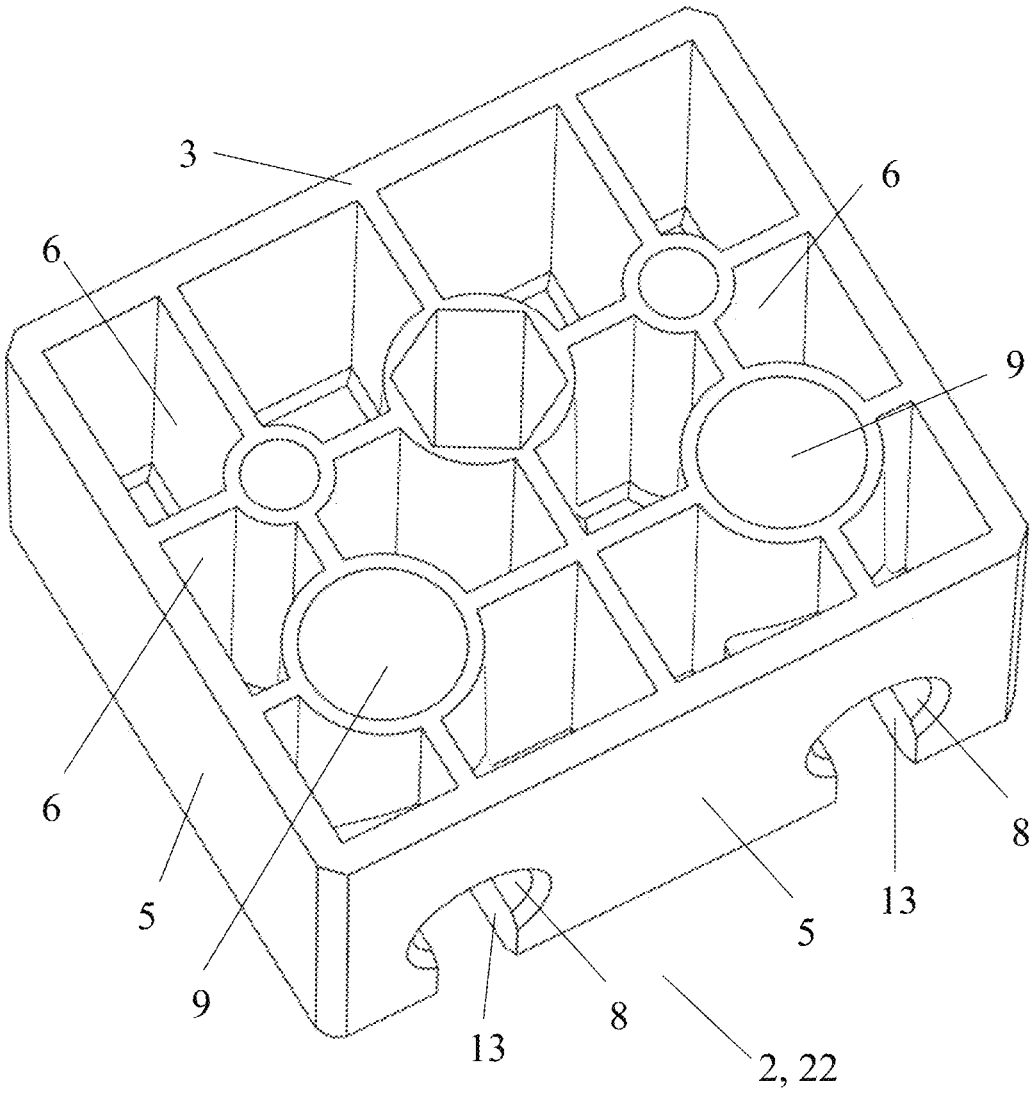
FIG. 4 is an upper perspective view of the support 2, 22.
Figure 5:
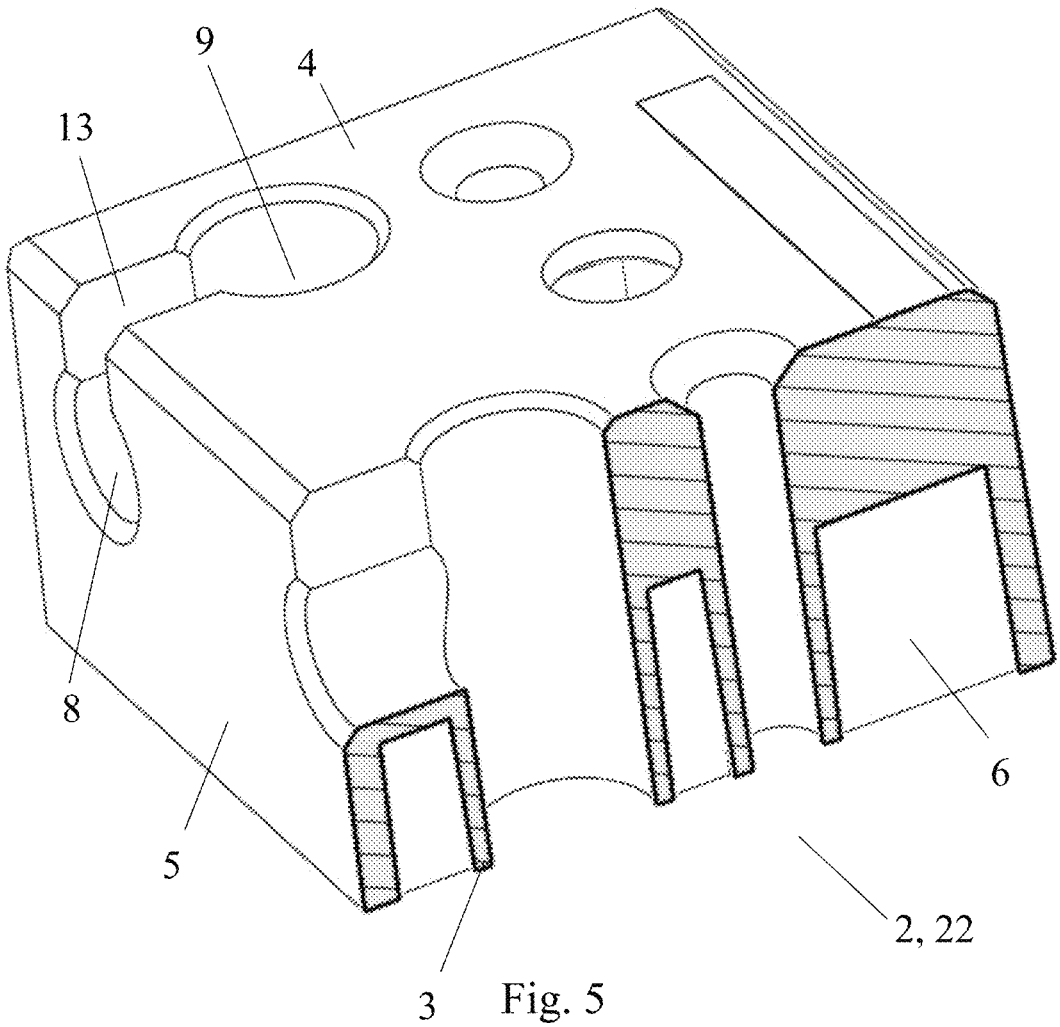
FIG. 5 is a sectional view of the support 2, 22 as seen in FIGS. 3 and 4.
Figure 6:
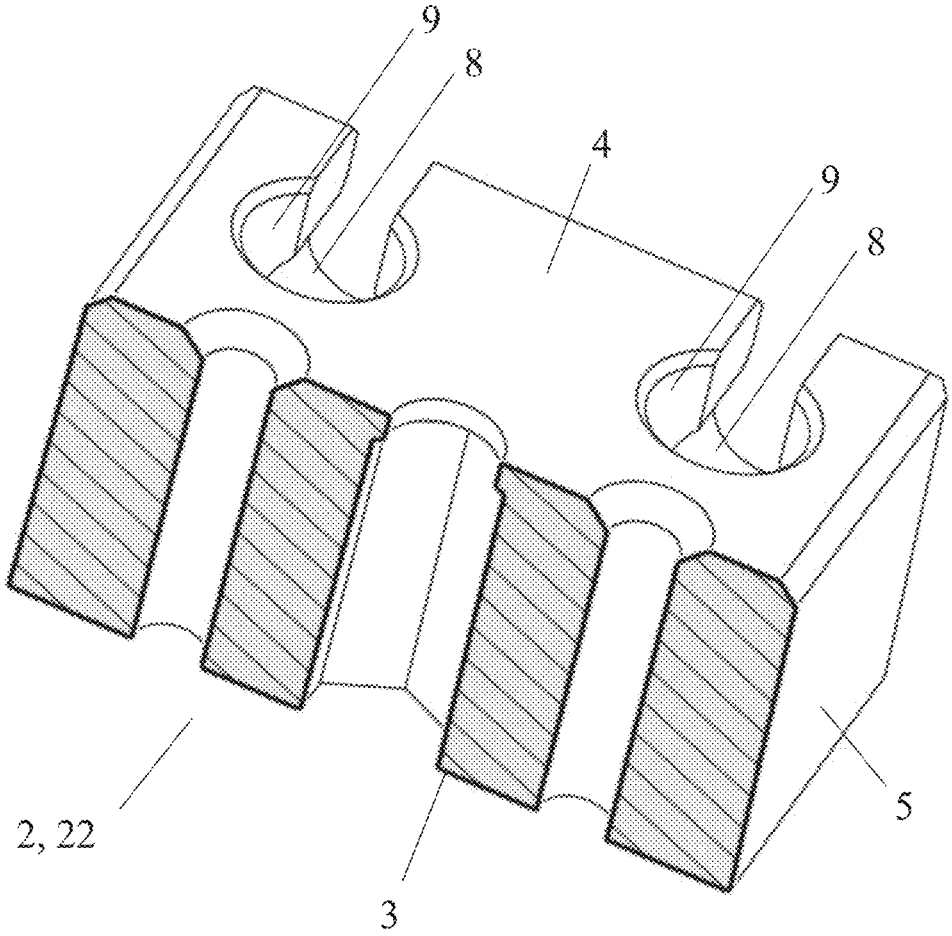
FIG. 6 is another sectional view of the support 2, 22 as seen in FIGS. 3 and 4.

In FIGS. 1 to 2 a hockey puck rebound device 1 comprises a first support 2 and a second support 22. Both supports 2 and 22 are associated through a cross-member 30. The cross-member 30 extends between the first support 2 and the second support 22 and is fixed to the top wall 3 of both supports 2, 22 so that both supports 2, 22 are positioned from each other with a distance X. The device 1 further comprises at least one resilient member 20 having a first and a second end and extending between the first support 2 and the second support 22 such that the resilient member 20 is secured in a taut manner to provide a resilient spring-back force when struck by a puck 50. FIG. 11 shows the device 1 positioned on a training surface 51 so that the puck 50 may be passed onto the resilient member 20 of the device 1. The supports 2 and 22 further comprises a rubber pad 40 to provide better gripping properties between the device 1 and the training surface 50.

Figure 7:
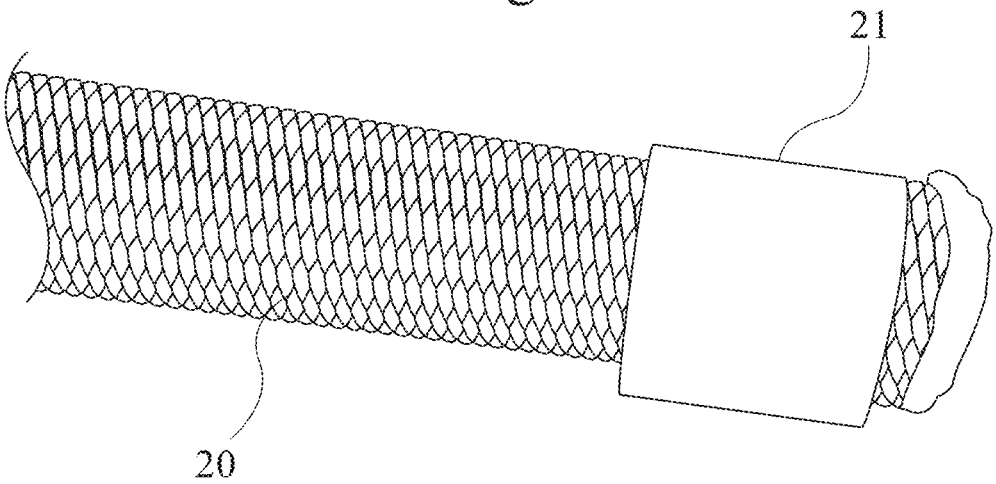
FIG. 7 is a perspective view of one end of a resilient member 20 comprising a rigid ring 21 thereon.

The resilient member 20 on each of its ends comprises a rigid ring 21 so that the end of the resilient member 20 is rigid (see FIG. 7). The rigid ring 21 improves gripping capabilities of the resilient member 20 to be holed in the second section 9 of the channel 7.

In FIGS. 3 to 6, 8 and 10 each support 2 and 22 comprises a top wall 3, a bottom wall 4 and four side walls 5 of substantially equal length, wherein the support 2, 22 is a hollow body with support ribs 6 therein. Each support 2 and 22 comprises two channels 7 for inserting and securing the resilient member 20 to the respective support 2, 22. The channel 7 is divided in two sections—a first section 8 of the channel 7 and a second section 9 of the channel 7. Both sections 8, 9 of the channel 7 are arranged 90 degrees relative to each other creating a channel 7 with 90 degree turn. The first section 8 of the channel 7 comprises a cut-out 13 parallel to a longitudinal axis of the first section 8 of the channel 7. The cut-out 13 is configured so that the resilient member 20 is insertable into the channel 7 through said cut-out 13. Upon insertion of the resilient member 20 into the channel 7 the resilient member is arranged in the first section 8 and the second section 9 of the channel 7. The rigid ring 21 of the resilient member 20 is located in the second section 9 of the channel 7. The support 2, 22 further comprises one hexagonal cavity 10 configured for insertion of a respective hexagonal nut 41 therein. The support further comprises two through holes 12, wherein each through hole 12 is configured for insertion of a screw 44 therethrough in order to fix the cross-member 30 to the support 2, 22.

In another embodiment the device 1 is attached to the training surface 51 by means of a bolt 42 that is inserted through an opening of the training surface 51 into a hexagonal nut 41 positioned in a hexagonal cavity 10 of a support 2, 22 (see FIG. 9).

While particular embodiments of the invention have been shown and described, numerous variations alternate embodiments will occur to those skilled in the art.

LIST OF REFERENCES:

1—a hockey puck rebound device;
2—a first support;
22—a second support;
3—a top wall of a first support and a second support;
4—a bottom wall of a first support and a second support;
5—a side wall of a first support and a second support;
6—a support rib;
7—a channel;
8—a first section of a channel;
9—a second section of a channel;
10—a hexagonal cavity;
12—a through hole;
13—a cut-out;
20—a resilient member;
21—a rigid ring;
30—a cross member;
40—a pad;
41—a nut;
42—a hexagonal bolt;
43—a washer;
44—a screw;
50—a puck;
51—a training surface;
X—a distance between the supports.

The invention claimed is:

1. A hockey puck rebound device (1), comprising:

a first support (2) and a second support (22), wherein each support (2; 22) comprising a top wall (3), a bottom wall (4) and four side walls (5) of substantially equal length, wherein each of the first and second supports include a hollow body with support ribs (6) therein;

at least one resilient member (20) having a first and a second end and extending between the first support (2) and the second support (22) such that the at least one resilient member (20) is secured in a taut manner to provide a resilient spring-back force when struck by a puck (50), wherein a rigid ring (21) is arranged on each end of the at least one resilient member (20) so that the end of the at least one resilient member (20) is rigid, allowing easy assembly and disassembly of the at least one resilient member (20) to and from the first and second supports (2; 22);

a cross-member (30) extending between the first support (2) and the second support (22) and fixed to the top wall (3) of both supports (2, 22) so that both supports (2, 22) are positioned from each other with a distance (X);

wherein each support (2, 22) comprises:

at least one channel (7) for inserting and securing the resilient member (20) to the first and second supports (2, 22), wherein the channel (7) includes a first section (8) and a second section (9) and a 45 to 90 degree curve between said first (8) and second (9) sections so that upon insertion of the at least one resilient member (20) into the channel (7) the at least one resilient member is arranged in the first (8) and the second section (9) of the channel (7), wherein the first section (8) of the channel (7) comprises a cut-out (13) parallel to a longitudinal axis of the first section (8) of the channel (7) so that through the cut-out (13) the resilient member (20) is insertable into the channel (7);

at least one hexagonal cavity (10) configured for insertion of a respective hexagonal nut (41) therein;

at least two through holes (12), wherein each through hole (12) is configured for insertion of a screw (44) therethrough in order to fix the cross-member (30) to the first and second supports (2, 22).

2. The hockey puck rebound device (1) according to claim 1, characterized in that the device (1) further comprises a rubber pad (40) attached to the bottom surface (4) of the support (2; 22) covering thereof.

3. The hockey puck rebound device (1) according to claim 1, characterized in that a diameter of the second section (9) of the channel (7) is larger than a diameter of the first section (8) of the channel (7) providing easy installation and secure holding of the resilient member (20) with its rigid rings (22) in the support (2;22).

4. The hockey puck rebound device (1) according to claim 1, characterized in that the device further comprises a means for securing said frame to a training surface in a stationary manner, wherein the means comprises:

a hexagonal nut (41) configured so that upon insertion of the hexagonal nut (41) in the hexagonal cavity (10) of the support (2; 22), the rotational movement within the hexagonal cavity (10) is avoided;

a bolt (42) configured to be screwed into the hexagonal nut (41) so that the support (2, 22) is secured to the training surface (51) in a stationary manner;

a washer (43) arranged onto the bolt (42) and positioned between the bottom wall (4) of the support (2, 22) and the training surface (51).

5. The hockey puck rebound device (1) according to claim 1, characterized in that the device further comprises a spike configured to be insertable into the hexagonal nut (41) arranged within the hexagonal cavity (10) of the support (2, 22).

6. The hockey puck rebound device (1) according to claim 1, characterized in that each support (2, 22) comprises two parallel arranged channels (7) for inserting and securing the resilient member (30) to the support (2, 22) and the device (1) comprises two resilient members (20), wherein each resilient member (20) is inserted and secured into the channel (7) of the support (2 ,22) so that two resilient members (20) are parallelly arranged between the supports (2, 22).

* * * * *